US006691790B1

(12) United States Patent
MacDonald, III et al.

(10) Patent No.: US 6,691,790 B1
(45) **Date of Patent: *Feb. 17, 2004**

(54) FIRE-SUPPRESSION SPRINKLER SYSTEM AND METHOD FOR INSTALLATION AND RETROFIT

(75) Inventors: Norman J. MacDonald, III, Lunenberg; Peter M. MacDonald, Boxboro, both of MA (US)

(73) Assignee: PNM, Inc., Boxboro, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/700,297

(22) PCT Filed: May 11, 1999

(86) PCT No.: PCT/US99/10222

§ 371 (c)(1),
(2), (4) Date: Jan. 2, 2002

(87) PCT Pub. No.: WO99/58200

PCT Pub. Date: Nov. 18, 1999

Related U.S. Application Data

(63) Continuation of application No. 09/076,078, filed on May 11, 1998, now Pat. No. 6,076,608.

(51) Int. Cl.[7] ..... A62C 35/00; A62C 37/68; B05B 15/10; B05B 3/00

(52) U.S. Cl. ..... 169/16; 169/39; 239/208; 239/209

(58) Field of Search ..... 169/16, 37, 38, 169/39, 40, 41, 43, 45–47, 64; 239/208, 209; 138/118, 119, 121, 109; 52/168; 354/63

(56) References Cited

U.S. PATENT DOCUMENTS 3,633,676 A * 1/1972 Gloeckler ..... 169/37
3,738,429 A * 6/1973 Heller et al. ..... 169/16
4,079,786 A 3/1978 Moling
4,265,979 A * 5/1981 Baehr et al. ..... 428/171
4,361,189 A 11/1982 Adams
4,834,186 A 5/1989 Ballard
4,880,063 A * 11/1989 Leininger et al. ..... 169/37
5,037,140 A * 8/1991 Anderson ..... 285/139.2
5,097,906 A 3/1992 Polan
5,327,976 A 7/1994 Hattori
5,632,338 A * 5/1997 Hunter ..... 169/9
5,682,925 A 11/1997 Seckel
5,758,694 A * 6/1998 Friedrich et al. ..... 138/144
5,794,853 A * 8/1998 Perkins ..... 239/208
5,909,777 A * 6/1999 Jamison ..... 169/43
6,076,608 A * 6/2000 MacDonald, III et al. .... 169/16

FOREIGN PATENT DOCUMENTS

GB 2063536 A 6/1981

* cited by examiner

*Primary Examiner*—Lesley D. Morris
*Assistant Examiner*—Davis Hwu
(74) *Attorney, Agent, or Firm*—Fish & Richardson P.C.

(57) ABSTRACT

A fire suppression sprinkler system (10), and method for installing a sprinkler system (10)in new and existing buildings. The system includes a manifold (12) that supplies fire-suppression fluid to a set of wall-mounted sprinkler heads (14) via flexible sprinkler head conduits (16) through an unobstructed path (18). The installation and retrofit methods include determining the location of the sprinkler head (14), installing the manifold (12), making sure that there is an unobstructed path (18) between the manifold (12) and the sprinkler head location, running the conduit (16) through the path (18) by snaking it where necessary through the wall (50) to which the sprinkler head (14) is mounted, connecting the conduit (16) to the manifold (12) and sprinkler head (14), and then mounting the sprinkler head (14).

134 Claims, 3 Drawing Sheets

FIRE-SUPPRESSION SPRINKLER SYSTEM AND METHOD FOR INSTALLATION AND RETROFIT

This application is a 371 of PCT/US99/10222 filed May 11, 1999 and a con't of Ser. No. 09/076,078 filed May 11, 1998 U.S. Pat. No. 6,076,608.

BACKGROUND OF THE INVENTION

1. Field of the Invention

The present invention relates to fire suppression sprinkler systems, more particularly, to sprinkler systems that are relatively easy to install in new construction and to retrofit into existing construction.

2. The Prior Art

Most cities and towns require fire-suppression sprinkler systems in commercial and multi-family residential buildings, and more and more city and town fire codes are requiring fire suppression sprinkler systems to be installed in existing buildings, particularly when they are renovated.

And increasing numbers of families, knowing of studies that how that sprinkler systems are effective in prevent injury and death due to fire, are having sprinkler systems installed into new houses and are having existing houses retrofitted. Conventional sprinkler systems are generally unsuited for installation in the typical house, particularly when the house is being retrofitted with a sprinkler system.

Conventional sprinkler systems include a rigid, stationary fire-suppression fluid supply grid comprising a plurality of interconnected pipes rigidly supported above the ceiling. A plurality of sprinkler assemblages are connected to the fluid supply grid and have heat-sensitive sprinkler heads that extend through the ceiling into the room being protected. There are situations when this rigid system is not feasible. For example, most two-story homes do not have enough space houses do not have enough attic or crawl space to hold the pipes or to easily access the pipes when they are installed.

As a result, the sprinkler heads are mounted high on the walls and fed from a basement grid, with the sprinkler heads being fed by rigid pipes extending inside the walls. When a house is being retrofitted, the walls must be torn out to install the pipes and then rebuilt, a very expensive and inconvenient process. Even in new residential and commercial constructions, the labor costs associated with installing large amounts of rigid pipe in the walls can be prohibitively expensive.

Consequently, there continues to exist a need for a method and the associated equipment to install fire suppression sprinkler systems in new homes and commercial construction and to retrofit existing construction that is convenient and fast relative to existing methods and equipment.

SUMMARY OF THE INVENTION

An object of the present invention is to provide a system and method for retrofitting an existing building with a fire-suppression sprinkler system that causes a minimum of disturbance in both time and construction to the building.

Another object is to provide a fire-suppression sprinkler system for installing into a new building or retrofitting an existing building that is much less labor intensive than current systems.

Yet another object is to provide a relatively economical method for installing a fire-suppression sprinkler system into a new building.

A further object is to provide a relatively economical method for retrofitting an existing building with a fire suppression sprinkler system.

The fire suppression sprinkler system of the present invention includes a manifold that supplies fire-suppression fluid, typically water, to a set of sprinkler heads via flexible sprinkler head conduits through an unobstructed path. The construction of the manifold is well-known in the art and a typically includes a pressure gauge, a shut-off valve, a check valve, a flow detector that triggers an audible alarm, a secondary pressure gauge, an auxiliary shut-off valve, and an outlet that provides water to the conduits. The sprinkler head is a typical prior art, temperature-sensitive sprinkler head designed to be used in sprinkler systems and to be mounted on a wall. The sprinkler head is typically mounted high up on the wall to get the maximum dispersion of water. A typical mount includes a box that is recessed into the wall and a plate that is removably mounted to the box. The sprinkler head is mounted in an opening in the plate. The box includes an aperture for the conduit.

The conduit is a length of flexible hose with a connector at each end. One aspect of the present invention is the ability to retrofit a building with a minimum of disturbance. Another aspect is the ability to include a sprinkler system in a new building at minimal cost without sacrificing protection. A flexible conduit can be run or snaked through the hollow of a wall without having to open up the wall. All that is needed is an unobstructed path from the manifold to the sprinkler head. A flexible conduit can be bent as needed without the need for joints, which minimizes the opportunity for leaks and greatly reduces the amount of work necessary and the costs associated with such work.

There is a connector on each end of the hose to connect to the manifold and to the sprinkler head. One form of connector includes an internal thread in the conduit and a mating external thread on the manifold outlet and/or sprinkler head. Other common connectors include flared fittings, compression fittings, Victolic connectors, and grooved connectors, all well-known in the art.

The present invention includes a method for installing a fire suppression sprinkler system in a building under construction. Steps include determining the location of the sprinkler head, installing the manifold, making sure that there is an unobstructed path between the manifold and sprinkler head location, running the conduit through the path, connecting the conduit to the manifold and sprinkler head, and then mounting the sprinkler head. This particular order of steps is merely illustrative.

The present invention also includes a method for retrofitting existing buildings with a fire suppression sprinkler system. Steps include determining the location of the sprinkler head, installing the manifold, making sure that there is an unobstructed path between the manifold and sprinkler head location by removing or defeating any obstructions, running the conduit through the path by snaking it through the wall to which the sprinkler head is mounted, connecting the conduit to the manifold and sprinkler head, and then mounting the sprinkler head. As above, this particular order of steps is merely illustrative.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

Figure 2:
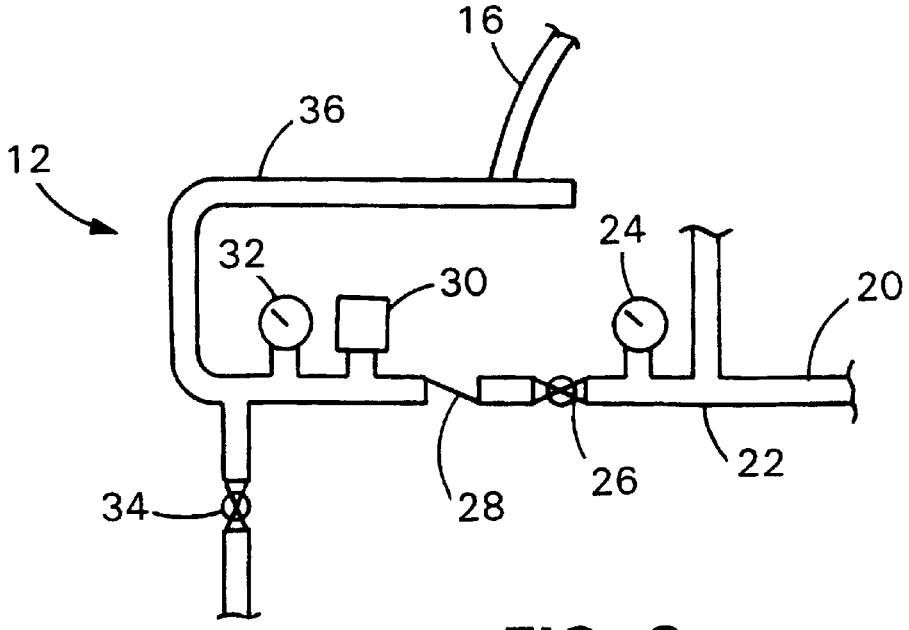
FIG. 2 is a schematic drawing of a manifold.

The fire suppression sprinkler system 10 of the present invention includes a manifold 12 that supplies fire suppression fluid, typically water, to a set of sprinkler heads 14 via flexible sprinkler head conduits 16 through an non-obstructed path 18. The construction of the manifold 12 is well-known in the art and a typical manifold is shown in FIG. 2. The manifold 12 includes an enclosure 13 and is supplied by water via a tap 22 off of the main water supply 20. A pressure gauge 24 indicates the pressure of the water in the main water supply. A shut-off valve 26 shuts off water pressure to the sprinkler system so that work may be performed on the system without interrupting water to the rest of the building. A check valve 28 prevents the back flow of water from the sprinkler system to the main water supply, eliminating the risk of stagnant and potentially contaminated sprinkler water mixing with drinking water. A flow detector 30 triggers an audible alarm if water flows through it, indicating that at least one of the sprinkler heads 14 has activated. A secondary pressure gauge 32 provides insurance against stuck or closed valves. An auxiliary shut-off valve 34 allows the sprinkler system 10 to be drained when maintenance is needed. The manifold outlet 36 provides water to the conduits 16. The manifold 12 may include a distribution grid of rigid pipes to which the conduits 16 are connected. The extent of the grid depends upon the size of the building and the amount of sprinkler coverage required.

Figure 4:
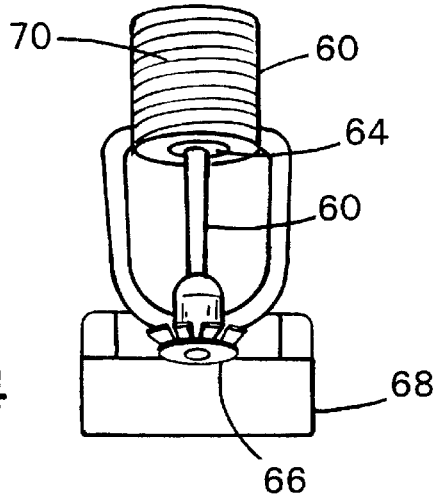
FIG. 4 is a perspective view of a sprinkler head.

The sprinkler head 14, as shown in FIG. 4, is a typical prior art, temperature-sensitive sprinkler head designed to be used in sprinkler systems. The sprinkler head 14 is provided with a length of cylindrical pipe 60 that is obstructed by a central plug 62. The plug 62 is held in place by a glass vial 64 of glycerin that expands when heated to break the vial 64 or by one or more links that are designed to melt at between about 130° F. and 212° F. When, due to heat and/or fire, the vial 64 breaks or the links melt, the plug 62 is dislodged from the pipe 60 by the force of the water acting against it. The water is dispersed over a large area by a dispersion device 66. A sprinkler head that is intended to be mounted on a wall generally includes a plate 68 that directs any upwardly-moving water back downward. The outer surface of the pipe 60 is threaded, as at 70, for connection to the conduit 16.

Figure 5:
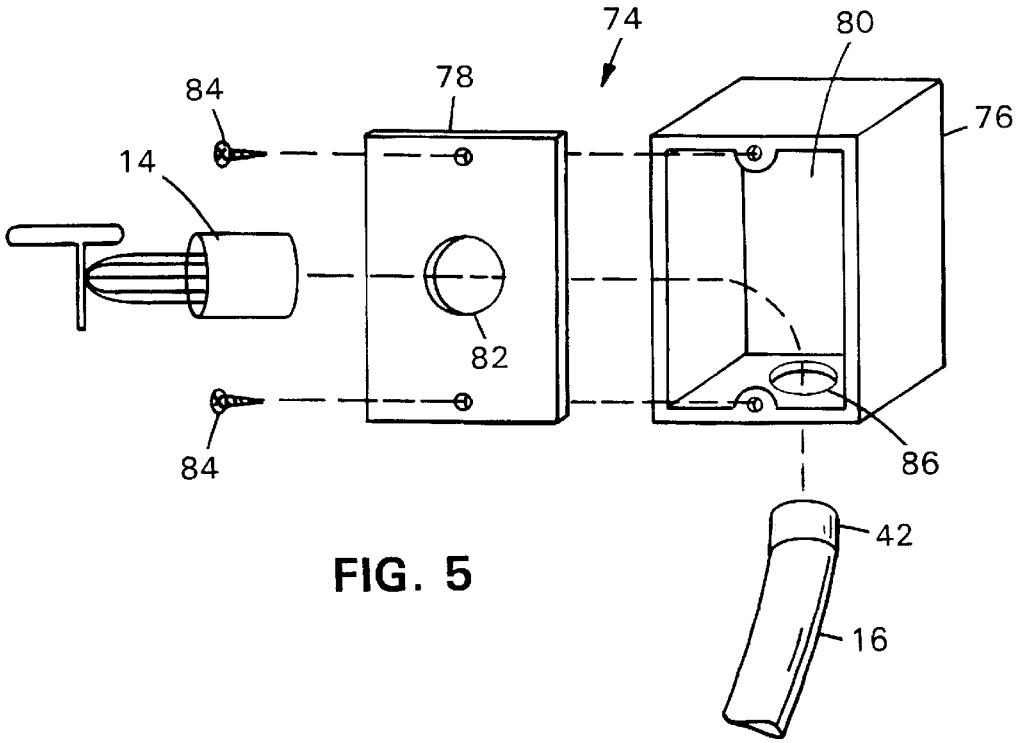
FIG. 5 is an exploded, perspective view of a sprinkler head wall mount.

The sprinkler head 14 is mounted to the wall 50 via a wall mount 74, typically high up on the wall 50 to get the maximum dispersion of water. A typical mount 74 is shown in FIG. 5, and includes a box 76 and a plate 78. The box 76 is recessed into the wall 50, with its open face 80 approximately flush with the wall 50. The sprinkler head 14 is mounted in an opening 82 in the plate 78 and the plate 78 attaches to the box 76, typically by a pair of removable screws 84. The conduit 16 runs through an aperture 86 in the box 76. The aperture 86 is-preferably large enough so that the conduit 16 can be pulled through easily when the plate 78 is removed and pushed through easily when the plate 78 is installed.

Figure 1:
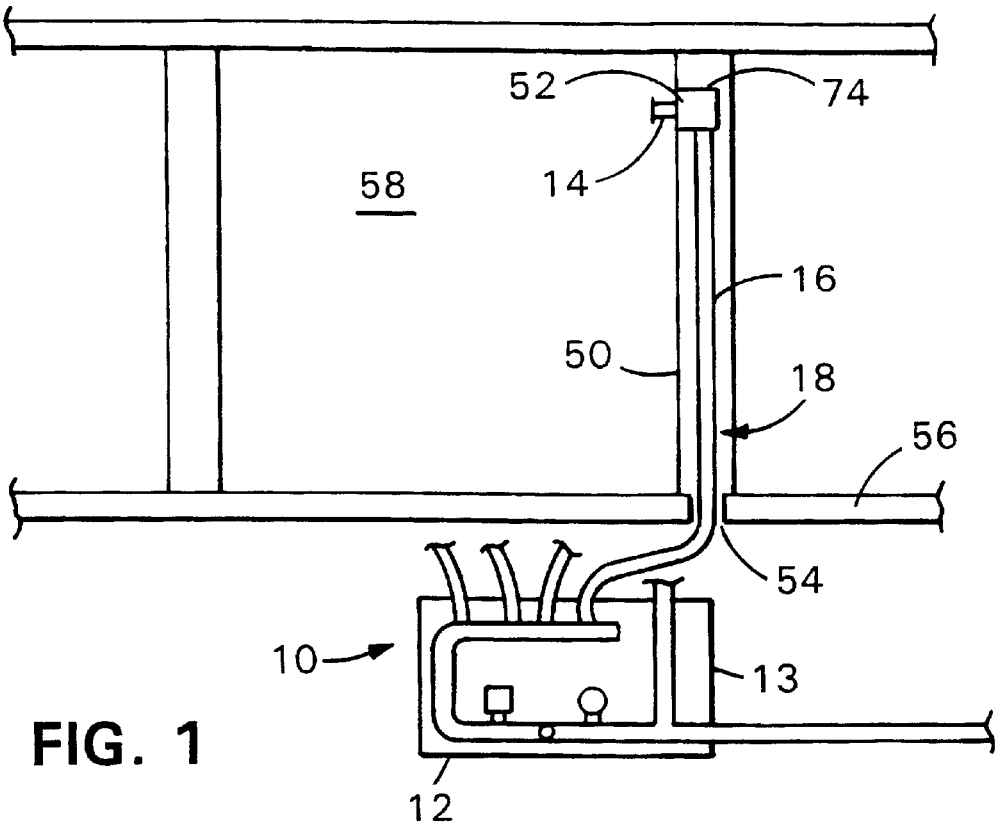
FIG. 1 is a cross-sectional view of a portion of a building showing the present invention.

The conduit 16 supplies water to the sprinkler head 14. The conduit 16 is a length of flexible hose 38 that has a connector 40, 42 at each end. One aspect of the present invention is the ability to retrofit a building with a minimum of disturbance. Another aspect is the ability to include a sprinkler system in a new building at minimal cost without sacrificing protection. As shown in FIG. 1, a flexible conduit 16 can be run through the hollow of a wall 50 without having to open up the wall 50, much in the same way that electrical wiring is installed. Generally, all that is needed is a hole 52 for the sprinkler head mount 74 and holes 54 in the horizontal wall studs 56 through which the conduit 16 passes so that there is an unobstructed path 18 from the manifold outlet 36 to the sprinkler head 14.

Since the horizontal studs 56 are typically at the top and bottom of the wall 50, they are easily accessible for drilling the holes 54 through which the conduit 16 runs.

Also, a flexible conduit 16 can be routed as needed without the need for joints where the conduit 16 bends. Minimizing the number joints reduces proportionately the opportunity for leaks and it greatly reduces the amount of work necessary and the costs associated with such work.

A typical residential water supply provides between 60 and 100 pounds per square inch (psi) of water pressure. A typical commercial water supply provides sprinkler systems with pressures of about 175 psi. The flexible hoses for each system must be able to handle corresponding water pressures of at least these amounts, and preferably higher in the event there are pressure surges.

The hose 38 is designed to be resistant to kinking and damage during installation. Kinking is generally occurs when using a hose material that is too weak to prevent bending the hose in a tighter radius than it was designed for. A kink in the hose 38 will partially or completely block passage of water and prevent water from reaching the sprinkler head 14 with sufficient pressure. The hose for the present invention is preferably designed to have a minimum radius of approximately 1 to 12 inches and is strong enough to prevent bending beyond the minimum radius.

Damage is a weakening of the hose wall and can be caused by scrapes, cuts, and impacts during the installation process. It is especially possible in blind installation, such as when a conduit 16 is being snaked through walls, with no visibility into the wall. For example, the hose may snag on a nail that is extending into the wall. A damaged hose is more vulnerable to bursting from water pressure over an extended period of time, such as the long periods of time that the sprinkler system is active between tests of the system.

The hose 38 is also designed to be heat and smoke resistant, a necessity since the sprinkler system must operate during a fire. Materials used to make the hose 38 heat and smoke resistant include polymers, metals, and treated rubberized materials.

Figure 3:
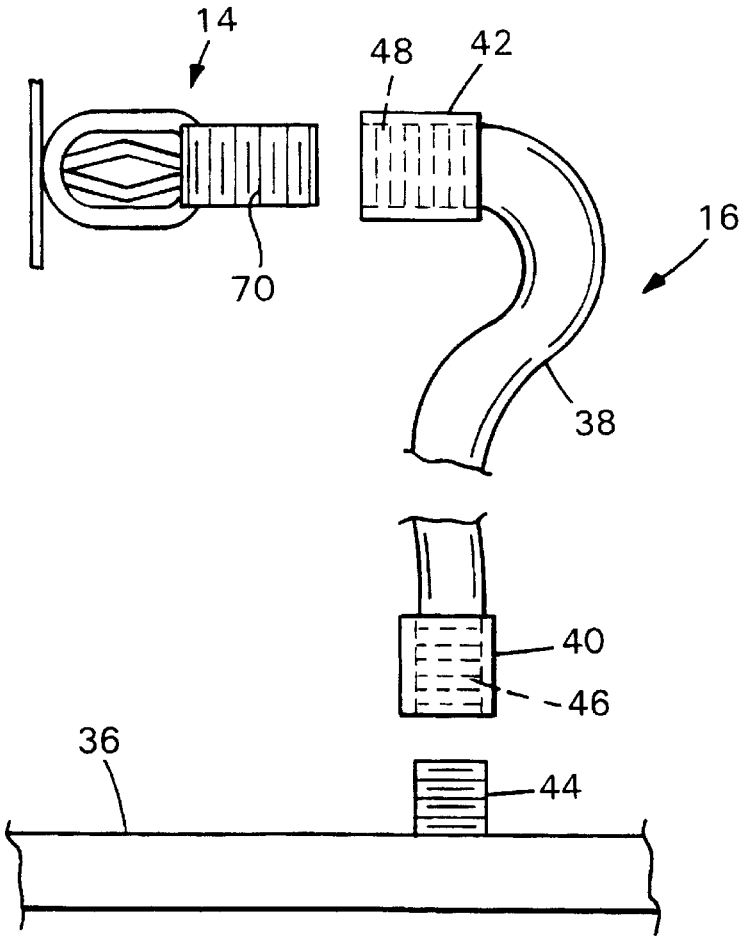
FIG. 3 is an exploded view of the conduit and connections.

As shown in FIG. 3, at one end of the hose 38 is a connector 40 to connect the conduit 16 to a manifold outlet 36 and at the other end of the hose 38 is a connector 42 for connection to the sprinkler head 14. It is also contemplated that a conduit may have more than one connector for connection to a sprinkler head. For example, if a single room needs two or more sprinkler heads, it may be easier and/or more economical to run a single flexible conduit from the manifold and put tee with a flexible conduit to each sprinkler head.

One form of connector 40, 42 includes an internal thread 46, 48 in the hose 38 adapted to accept an external thread 44 on the manifold outlet 36 or an external thread 70 on the sprinkler head 14. A gasket or other mechanism is employed to prevent water leaking at the connector. Other common connectors include flared fittings, compression fittings, Victolic connectors, and grooved connectors, all well-known in the art.

As indicated above, the present invention includes a method for installing a fire suppression sprinkler system in a building under construction. At least one wall 50 of the room 58 to be protected must be hollow for the conduit 16.

The first step is to install a manifold 12 so that it is connected to a supply of fire suppression fluid, such as water. The next step is to make sure that there is a path 18 between the manifold 12 and each sprinkler head 14 location that will be unobstructed and invisible from the room when building construction is complete. If there are any potential obstructions, they are either removed or defeated in some other way. The obstruction typically encountered is the horizontal stud 56 at the top and/or bottom of the hollow wall 50, which is defeated by cutting a notch or drilling a hole 54 large enough for the conduit 16 to loosely fit through. Next, the conduit 16 is run through the unobstructed path 18. Then the conduit 16 is connected at one end to the manifold outlet 36 and the sprinkler head 14 is connected to the other end. Finally, the sprinkler heads 14 are installed on the hollow walls 50. The order described is not necessarily the order in which the steps are actually taken. The actual order is determined by the manner in which the building is constructed. For example, if the water supply is not yet available, most of the other steps may be performed before the manifold is connected to the water supply.

Also as indicated above, the present invention includes a method for retrofitting existing buildings with a fire suppression sprinkler system. At least one wall 50 of the room 58 to be protected must be hollow for the conduit 16.

The first step is to install a manifold 12 so that it is connected to a supply of fire suppression fluid, such as water. Then the sprinkler head 14 is installed on the hollow wall 50. The next step is to make sure that there is an unobstructed path 18 between the manifold 12 and each sprinkler head 14. The path is chosen so that the conduit 16 is not visible from within the room 58 when installation is complete. If there are any obstructions in the way, the obstructions are either removed or defeated in some other way. The obstruction typically encountered is the horizontal stud 56 at the top and/or bottom of the hollow wall 50, which is defeated by drilling a hole 54 large enough for the conduit 16 to loosely fit through. Next, the conduit 16 is snaked through the unobstructed path 18 by any means available, such as by using an electrician's snake to pull the conduit 16 the through the path from the manifold to the sprinkler head or from the sprinkler head to the manifold. Finally, the conduit 16 is connected at one end to the manifold outlet 36 and at the other end to the sprinkler head 14. The order of steps described is not necessarily the order in which the steps are actually taken.

Any order that leads to the desired end result is contemplated. For example, it is generally more practical to snake the conduit 16 through-the unobstructed path 18 and connect it to the sprinkler head 14 before mounting the sprinkler head 14 to the wall 50.

Figure 6:
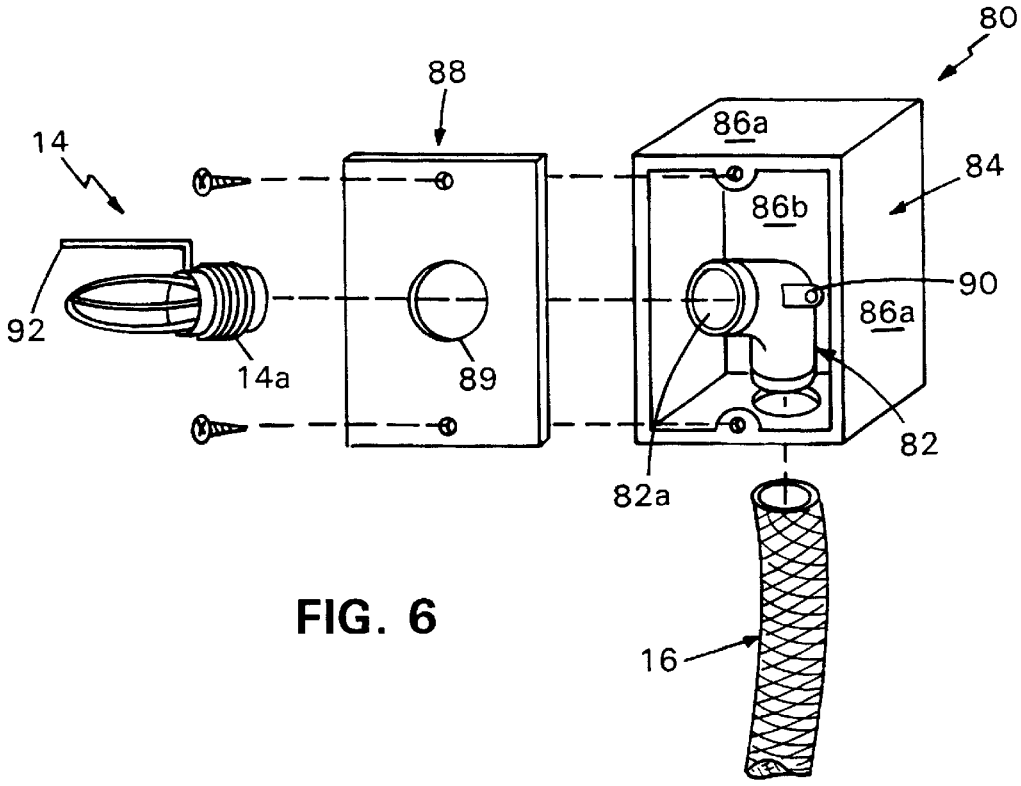
FIG. 6 is an alternative embodiment of a sprinkler head wall mount.

A wall mount 74 well-suited for use with a fire-suppression sprinkler system 10 was described above in conjunction with FIG. 5. Referring to FIG. 6, another embodiment of a wall mount 80 includes a rigid fitting 82 for coupling sprinkler head 14 to flexible conduit 16. Rigid fitting 82 is positioned within a junction box 84, here rectangular in shape, and defined by four side walls 86*a* and a rear wall 86*b*. Junction box 84 is sized to fit within a recess formed within a hollow wall so that an open face of the box is substantially flush with the outer surface of the wall. In new installations, junction box 84 is typically secured to a support member (e.g., wall stud) of the wall. In retrofit installations, the wall itself may be used to support junction box 84. A cover plate 88 is positioned over the open face of junction box 84 and includes an opening 89 through which a threaded end 14*a* of sprinkler head 14 extends to connect to a correspondingly threaded end 82*a* of rigid fitting 82. One or more fastening screws are used here to attach cover plate 88 to junction box 84.

Rigid fitting 82 includes a mounting flange 90 which is attached to a portion of junction box 84 or cover plate 88. In general, rigid fitting 82 provides mechanical stability to the sprinkler head and conduit assembly, particularly during operation when the assembly is subjected to significant mechanical (e.g., torsional) forces. In addition, junction box 84 and cover plate 88 provide a protective enclosure for sprinkler head 14 and its connection to conduit 16, while allowing easy access for repair or replacement of the sprinkler head or fitting. Furthermore, in many settings (e.g., residential), because junction box 84 is generally hidden with only plate 88 in view, the assembly provides an aesthetically pleasing appearance to an otherwise visually obtrusive device.

In the embodiment shown in FIG. 6, one of the side walls 82*a* includes an aperture 84 sized to allow flexible conduit 16 to extend therethrough. In this case, rigid fitting is a 90° bend drop elbow fitting to facilitate attachment to sprinkler head 14, which here is a horizontal-type sprinkler head having a deflector 92 for directing the fluid stream over the area to be protected from fire. In another embodiment (not shown), the aperture may be provided in rear wall 86*b*, in which case, a straight rigid fitting 82 is used.

Thus it has been shown and described a fire suppression sprinkler system which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A fire-suppression sprinkler system for protecting a room having a hollow wall, said system comprising:

a manifold having an input connected to a main water supply, said manifold having a plurality of outlets;

a sprinkler head for distributing the fire-suppression fluid over a desired area, the sprinkler head positioned remotely from the manifold;

a fluid distribution path including the manifold and extending from the main water supply to the remotely-located sprinkler head; and a bendable, flexible conduit defining substantially all of the fluid distribution path and operatively connecting said sprinkle head to one of said manifold outlets, a portion of said fluid distribution path being within said hollow wall.

2. The fire-suppression sprinkler system of claim 1 wherein the room is within a residential building and said bendable, conduit is not visible from within said room.

3. The fire-suppression sprinkler system of claim 1 wherein said conduit is removably connected sprinkler head.

4. The fire-suppression sprinkler system of claim 1 wherein said sprinkler head is removably mounted to structure associated with the room.

5. The fire-suppression sprinkler system of claim 1 wherein a substantial portion of said bendable, flexible conduit is within said hollow wall.

6. The fire-suppression sprinkler system of claim 1 wherein said conduit is kink-resistant.

7. The fire-suppression sprinkler system of claim 6 wherein said conduit has a minimum bend radius of between approximately one inch and twelve inches.

8. The fire-suppression sprinkler system of claim 1 further comprising a mount including:

housing defining an internal volume within which the sprinkler head is received, the housing having an aperture through which the flexible conduit extends to operatively connect to the sprinkler head and an open face; and a cover which covers the open face of the housing, the cover having an opening within which the sprinkler head extends.

9. The fire-suppression sprinkler system of claim 8 wherein the housing is configured to be positioned within a recess, such that the cover is substantially flush with structure associated with the room.

10. The fire-suppression system of claim 8 wherein the mount further comprises an elbow joint connected between the sprinkler head and flexible conduit, the elbow joint attached to the housing.

11. The fire-suppression sprinkler system of claim 1 wherein the flexible conduit is formed of a heat-resistant material.

12. The fire-suppression sprinkler system of claim 11 wherein the flexible conduit is formed of a smoke-resistant material.

13. The fire-suppression sprinkler system of claim 1 wherein the manifold includes a flow detector configured to trigger an audible alarm in response to the flow of fire-suppression fluid through the flow detector.

14. The fire-suppression sprinkler system of claim 1 wherein the manifold includes a check valve which prevents the back flow of fire-suppression fluid from the sprinkler system to a source of the fire-suppression fluid.

15. The fire-suppression sprinkler system of claim 1 wherein the bendable, flexible conduit is configured to allow flow of the fire-suppression fluid at levels of about 175 psi.

16. The fire-suppression sprinkler system of claim 1 wherein the bendable, flexible conduit is configured to receive a plurality of sprinkler heads.

17. The fire-suppression system of claim 16 further comprising a connector connected to a bendable, flexible conduit and connected to the plurality of sprinkler heads.

18. The fire-suppression system of claim 17 wherein the connector is in the form of a tee.

19. The fire-suppression system of claim 1 including a plurality of sprinkler heads and fluid distribution paths, each fluid distribution path associated with one of the plurality of sprinkler heads.

20. The fire-suppression system of claim 1 wherein the conduit is formed of a polymer.

21. The fire-suppression system of claim 1 wherein the conduit is formed of metal.

22. The fire-suppression system of claim 1 wherein to conduit is formed of rubberized material.

23. The fire-suppression system of claim 1 further comprising a connector between the conduit and the sprinkler head.

24. The fire-suppression system of claim 23 wherein the connector includes a water seal.

25. The fire-suppression system of claim 23 wherein the seal is a gasket.

26. The fire-suppression system of claim 23 wherein the seal is in the form of a flared fitting.

27. The fire-suppression system of claim 23 wherein the seal is in the form of a compression fitting.

28. The fire-suppression sprinkler system of claim 1 wherein the fluid distribution path extends through holes of a wall stud for supporting the structure associated with the room.

29. A method for installing a fire-suppression sprinkler system in a building under construction and having a room to be protected, said room having a hollow wall when construction is complete, said method comprising the steps of:

(a) connecting an input of a manifold to a main water supply, said manifold having a plurality of outlets;

(b) positioning a sprinkler head for providing the fire suppression fluid to the room to be protected at a sprinkler head location remote from the manifold;

(c) providing a fluid distribution path including the manifold and extending between said main water supply and said sprinkler head location that is not visible from said room after construction is complete;

(d) running a bendable, flexible conduit along substantially all of said fluid distribution path;

(e) operatively connecting an end of said bendable, flexible conduit to one of said manifold outlets; and (f) operatively connecting another end of said bendable, flexible conduit to said sprinkler head.

30. The method of claim 29 wherein said sprinkler head is removably mounted to the structure associated with the room.

31. The method of claim 29 wherein said building is a residential building.

32. The method of claim 29 wherein a substantial portion of said conduit is within the hollow wall.

33. The method of claim 29 wherein said conduit is kink-resistant.

34. The method of claim 29 wherein mounting the sprinkler head further includes:

providing a housing defining an internal volume and having an open face and an aperture;

positioning an end of the flexible conduit through the aperture in the housing;

attaching the sprinkler head to the end of the flexible conduit and placing the sprinkler head within the internal volume of the housing;

providing a cover having an opening over the open face of the housing, the sprinkler head extending through the opening.

35. The method of claim 34 further comprising:

providing a recess within the structure associated with the room; and positioning the housing within the recess.

36. The method of claim 29 further comprising forming the flexible conduit from a heat-resistant material.

37. The method of claim 29 further comprising forming the flexible conduit from a smoke-resistant material.

38. The method of claim 29 further comprising providing within the manifold a flow detector configured to trigger an audible alarm in response to the flow of fire-suppression fluid through the flow detector.

39. The method of claim 29 further comprising providing within the manifold a check valve which prevents the back flow of fire-suppression fluid from the sprinkler system of the fire-suppression fluid.

40. The method of claim 29 wherein the bendable, flexible conduit is configured to allow flow of the fire-suppression fluid at levels of about 175 psi.

41. The method of claim 29 further comprising connecting the bendable, flexible conduit to a plurality of sprinkler heads.

42. The method of claim 41 further comprising connecting the bendable, flexible conduit to the plurality of sprinkler heads within a connector.

43. The method of claim 42 wherein the connector is in the form of a tee.

44. The method of claim 34 wherein the mount further comprises an elbow joint connected between the sprinkler head and flexible conduit, the elbow joint attached to the housing.

45. The method of claim 29 comprising a plurality of sprinkler heads and fluid distribution paths, each fluid distribution path associated with one of the plurality of sprinkler heads.

46. The method of claim 29 comprising forming the conduit from a polymer.

47. The method of claim 29 comprising forming the conduit from a metal.

48. The method of claim 29 comprising forming the conduit from rubberized material.

49. The method of claim 29 further comprising connecting the conduit and the sprinkler head with a connector.

50. The method of claim 49 wherein the connector includes a water seal.

51. The method of claim 50 wherein the seal is a gasket.

52. The method of claim 50 wherein the seal is in the form of a flared of fitting.

53. The method of claim 50 wherein the seal is in the form of a compression fitting.

54. A method for retrofitting an existing building with a fire-suppression sprinkler system, said building having a room to be protected and said room having a hollow wall, said method comprising the steps of:

(a) connecting an input of a manifold to a main water supply, said manifold having a plurality of outlets:

(b) positioning a sprinkler head at a sprinkler head location remote from the manifold and for providing the fire suppression fluid to the room to be protected;

(c) providing a fluid distribution path including the manifold and extending between said main water supply and said sprinkler head location, said path not being visible from within said room;

(d) snaking a bendable, flexible conduit along substantially all of said fluid distribution path;

(e) operatively connecting an end of said bendable, flexible conduit to one of said manifold outlets; and (f) operatively connecting another end of said bendable, flexible conduit to said sprinkler head.

55. The method of claim 54 wherein holes are made in obstructions between said manifold locations and said sprinkler head location to provide said unobstructed path.

56. The method of claim 55 wherein said conduit is kink-resistant.

57. The method of claim 55 wherein making the holes in the obstructions to provide the unobstructed path includes making the holes in support structure associated with the room.

58. The method of claim 55 wherein said sprinkler head is removably mounted to structure associated with the room.

59. The method of claim 55 wherein building is a residential building.

60. The method of claim 55 wherein substantially the entire length of said flexible conduit is within said hollow wall.

61. The method of claim 55 wherein mounting the sprinkler head further includes:

providing a housing defining an internal volume and having an open dace and an aperture;

positioning an end of the flexible conduit through the aperture in the housing;

attached the sprinkler head to the end of the flexible conduit and placing the sprinkler head within the internal volume of the housing;

providing a cover having an opening over the open face of the housing, the sprinkler head extending through the opening.

62. The method of claim 61 further comprising:

providing a recess within structure associated with the room; and positioning the housing within the recess.

63. The method of claim 55 further comprising forming the flexible conduit from a smoke-resistant material.

64. The method of claim 55 further comprising providing within the manifold a flow detector configured to trigger an audible alarm in response to the flow of fire-suppression fluid through the flow detector.

65. The method of claim 55 further comprising providing within to manifold a check valve which prevents the back flow of fire-suppression fluid from the sprinkler system to the supply of the fire-suppression fluid.

66. The method of claim 55 wherein snaking the bendable, flexible conduit along the fluid distribution path includes using a snake to pull the conduit through structure associated with the room.

67. The method of claim 55 further comprising connecting the bendable, flexible conduit to a plurality of sprinkler heads.

68. The method of claim 67 further comprising connecting the bendable, flexible conduit to the plurality of sprinkler heads within a connector.

69. The method of claim 68 wherein the connector is in the form of a tee.

70. The method of claim 61 wherein the mount further comprises an elbow joint connected between the sprinkler head and flexible conduit, the elbow joint attached to the housing.

71. The method of claim 55 further comprising forming the flexible conduit from a heat-resistant material.

72. The method of claim 55 a plurality of sprinkler heads and fluid distribution paths, each fluid distribution path associated with one of the plurality of sprinkler heads.

73. The method of claim 55 comprising forming the conduit from a polymer.

74. The method of claim 55 comprising forming the conduit from metal.

75. The method of claim 55 comprising forming the conduit from rubberized material.

76. The method of claim 66 further comprising connecting the conduit and the sprinkler head with a connector.

77. The method of claim 76 wherein the connector includes a water seal.

78. The method of claim 77 wherein the seal is a gasket.

79. The method of claim 77 wherein the seal is in the form of a flared fitting.

80. The method of claim 77 wherein the seal is in the form of a compression fitting.

81. A fire-suppression sprinkler system for protecting a room having a hollow wall, said system comprising:

a manifold having an input connected to a main water supply, said manifold having a plurality of outlets, said manifold including:

an enclosure;

a conduit system disposed within the enclosure and extending between the input and outlet;

a flow detector disposed within the conduit system, the flow detector configured to trigger an audible alarm in response to the flow of fire-suppression fluid through the flow detector;

a check valve disposed within the conduit system, the check valve configured to prevent the back flow of fire-suppression fluid from the sprinkler system to the supply of the fire-suppression fluid;

a sprinkler head for distributing the fire-suppression fluid over a desired area, the sprinkler head positioned remotely from the manifold;

a fluid distribution path including the manifold and extending from the main water supply to the remotely-located sprinkler head; and a bendable, flexible conduit defining substantially all of the fluid distribution path and operatively connecting said sprinkler head to one of said manifold outlets, said conduit running through an unobstructed path from said manifold to said sprinkler head, a portion of said fluid distribution path being within said hollow wall.

82. The fire-suppression sprinkler system of claim 81 wherein the room is within a residential building and said bendable, conduit is not visible from within said room.

83. The fire-suppression sprinkler system of claim 81 wherein said conduit is removably connected to said sprinkler head.

84. The fire-suppression sprinkler system of claim 81 wherein said sprinkler head is removably mounted to structure associated with the room.

85. The fire-suppression sprinkler system of claim 81 wherein a substantial portion of said bendable, flexible conduit is within said hollow wall.

86. The fire-suppression sprinkler system of claim 81 wherein said conduit is kink-resistant.

87. The fire-suppression sprinkler system of claim 86 wherein said conduit has a minimum bend radius of between approximately one inch and twelve inches.

88. The fire-suppression sprinkler system of claim 81 further comprising a mount including:

housing defining an internal volume within which the sprinkler head is received, the housing having an aperture through which the flexible conduit extends to operatively connect to the sprinkler head and an open face; and a cover which covers the open face of the honing, the cover having an opening within which the sprinkler head extends.

89. The fire-suppression sprinkler system of claim 88 wherein the housing is configured to be positioned within a recess, such that the cover is substantially flush with structure associated with the room.

90. The fire-suppression sprinkler system of claim 89 wherein the flexible conduit is formed of a smoke-resistant material.

91. The fire-suppression sprinkler system of claim 81 wherein the bendable, flexible conduit is configured to receive a plurality of sprinkler heads.

92. The fire-suppression system of claim 91 further comprising a connector connected to a bendable, flexible conduit and connected to the plurality of sprinkler heads.

93. The fire-suppression system of claim 92 wherein the connector is in the form of a tee.

94. The fire-suppression system of claim 88 wherein the mount further comprises an elbow joint connected between the sprinkler head and flexible conduit, the elbow joint attached to the housing.

95. The fire-suppression sprinkler system of claim 81 wherein the flexible conduit is formed of a heat-resistant material.

96. The fire-suppression system of claim 81 including a plurality of sprinkler heads and fluid distribution paths, each fluid distribution path associated with one of the plurality of sprinkler heads.

97. The fire-suppression system of claim 81 wherein the conduit is formed of a polymer.

98. The fire-suppression system of claim 81 wherein the conduit is formed of metal.

99. The fire-suppression system of claim 81 wherein the conduit is formed of rubberized material.

100. The fire-suppression system of claim 81 further comprising a connector between the conduit and the sprinkler head.

101. The fire-suppression system of claim 100 wherein the connector includes a water seal.

102. The fire-suppression system of claim 101 wherein the seal is a gasket.

103. The fire-suppression system of claim 101 wherein the seal is in the form of a flared fitting.

104. The fire-suppression system of claim 101 wherein the seal is in the form of a compression fitting.

105. The fire-suppression sprinkler system of claim 81 wherein the fluid distribution path extends through holes of a wall stud for supporting the structure associated with the room.

106. A fire-suppression sprinkler system for protecting a room having a hollow wall, said system comprising:

a plurality of sprinkler heads;

a water supply manifold remotely located from the sprinkler heads;

a plurality of flexible conduits defining a network capable of carrying water flow, at least one of the conduits operatively connecting one of the plurality of sprinkler heads to said manifold;

a connector for connecting said at least one of the conduits operatively connecting said one of the plurality of sprinkler heads;

a main water supply fluidly coupled to the network for supplying the system with water; and a water distribution path including the manifold and defined by substantially all of said at least one of the conduits operatively connecting said one of the plurality of sprinkler heads, the water distribution path extending from the main water supply to the sprinkler head, a portion of said water distribution path being within said hollow wall.

107. The fire-suppression sprinkler system of claim 106 wherein the room is within a residential building and said bendable, conduit is not visible from within said room.

108. The fire-suppression sprinkler system of claim 106 wherein said conduit is removably connected to said sprinkler head.

109. The fire-suppression sprinkler system of claim 106 wherein said sprinkler head is removably mounted to structure associated with the room.

110. The fire-suppression sprinkler system of claim 106 wherein a substantial portion of said bendable, flexible conduit is within said hollow wall.

111. The fire-suppression sprinkler system of claim 106 wherein said conduit is kink-resistant.

112. The fire-suppression sprinkler system of claim 111 wherein said conduit has a minimum bend radius of between approximately one inch and twelve inches.

113. The fire-suppression sprinkler system of claim 106 further comprising a mount including:

housing defining an internal volume within which the sprinkler head is received, the housing having an aperture through which the flexible conduit extends to operatively connect to the sprinkler head and an open face; and a cover which covers the open face of the housing, the cover having an opening within which the sprinkler head extends.

114. The fire-suppression sprinkler system of claim 113 wherein the housing is configured to be positioned within a recess, such that the cover is substantially flush with structure associated with the room.

115. The fire-suppression sprinkler system of claim 106 wherein the flexible conduit is formed of a smoke-resistant material.

116. The fire-suppression sprinkler system of claim 106 wherein the manifold includes a flow detector configured to trigger an audible alarm in response to the flow of fire-suppression fluid through the flow detector.

117. The fire-suppression sprinkler system of claim 106 wherein the manifold includes a check valve which prevents the back flow of fire-suppression fluid from the sprinkler system to a source of the fire-suppression fluid.

118. The fire-suppression sprinkler system of claim 106 wherein the bendable, flexible conduit is configured to allow flow of the fire-suppression fluid at levels of about 175 psi.

119. The fire-suppression sprinkler system of claim 106 wherein the bendable, flexible conduit is configured to receive a plurality of sprinkler heads.

120. The fire-suppression system of claim 119 further comprising a connector connected to a bendable, flexible conduit and connected to the plurality of sprinkler heads.

121. The fire-suppression system of claim 120 wherein the connector is in the form of a tee.

122. The fire-suppression system of claim 115 wherein the mount further comprises an elbow joint connected between the sprinkler head and flexible conduit, the elbow joint attached to the housing.

123. The fire-suppression sprinkler system of claim 106 wherein the flexible conduit is formed of a heat-resistant material.

124. The fire-suppression system of claim 106 wherein each of the plurality of flexible conduits is associated with at least one of the plurality of sprinkler heads.

125. The fire-suppression system of claim 106 wherein the conduit is formed of a polymer.

126. The fire-suppression system of claim 106 wherein the conduit is formed of metal.

127. The fire-suppression system of claim 106 wherein the conduit is formed of rubberized material.

128. The fire-suppression system of claim 106 further comprising a connector between the conduit and the sprinkler head.

129. The fire-suppression system of claim 128 wherein the connector includes a water seal.

130. The fire-suppression system of claim 129 wherein the seal is a gasket.

131. The fire-suppression system of claim 129 wherein the seal is in the form of a flared fitting.

132. The fire-suppression system of claim 129 wherein the seal is in the form of a compression fitting.

133. The fire-suppression sprinkler system of claim 106 wherein the fluid distribution path extends through holes of a wall stud for supporting the structure associated with the room.

134. A fire-suppression sprinkler system for protecting a room having a hollow wall, said system comprising:

a manifold having an input connected to a main water supply, said manifold having a plurality of outlets;

an enclosure;

a conduit system disposed within the enclosure and extending between the input and one of the outlets of the manifold;

a flow detector disposed within the conduit system, the flow detector configured to trigger an audible alarm in response to the flow of fire-suppression fluid through the flow detector;

a check valve disposed within the conduit system, the check valve configured to prevent the back flow of fire-suppression fluid from the sprinkler system to the main water supply;

a sprinkler head;

a fluid distribution path including the manifold and extending from the main water supply to the sprinkler head;

a flexible conduit defining substantially all of the fluid distribution path and operatively connecting said sprinkler head to one said manifold outlets, said conduit running through an unobstructed path from said manifold to said sprinkler head, a portion of said path being within said hollow wall.

* * * * *